US008556527B1

(12) United States Patent
Chou

(10) Patent No.: US 8,556,527 B1
(45) Date of Patent: Oct. 15, 2013

(54) LIPSTICK CASE

(71) Applicant: Yu-Hsing Chou, Tainan (TW)

(72) Inventor: Yu-Hsing Chou, Tainan (TW)

( * ) Notice: Subject to any disclaimer, the term of this patent is extended or adjusted under 35 U.S.C. 154(b) by 0 days.

(21) Appl. No.: 13/744,506

(22) Filed: Jan. 18, 2013

(51) Int. Cl.
*B43K 23/00* (2006.01)

(52) U.S. Cl.
USPC ..... 401/98; 215/237; 220/230

(58) Field of Classification Search
USPC ..... 401/98, 202, 213, 243, 262, 269; 215/234, 237, 273, 295, 303; 220/230
See application file for complete search history.

(56) References Cited

U.S. PATENT DOCUMENTS 4,168,129 A * 9/1979 Herrnring ..... 401/243
2009/0297250 A1* 12/2009 Huang ..... 401/243

* cited by examiner

*Primary Examiner* — David Walczak
(74) *Attorney, Agent, or Firm* — Alan Kamrath; Kamrath IP Lawfirm, P.A.

(57) ABSTRACT

A lipstick case includes a case holder, a lid, and first and second positioning members. The case holder includes an upper end face and a surrounding wall with non-circular cross sections. The lid is removably covered on the upper end face of the case holder. The first positioning member is mounted on the upper end face of the case holder and includes several lower magnets. Each lower magnet has an upper end which is one of north and south seeking poles. The second positioning member is engaged on a lower end face of the lid and includes several upper magnets. Each upper magnet has a lower end which is the other of the north and south seeking poles. The lower end face of the lid over the case holder is able to attract and engage with the upper end face of the case holder by the upper and lower magnets.

4 Claims, 9 Drawing Sheets

LIPSTICK CASE

BACKGROUND OF THE INVENTION

The present invention relates to a lipstick case and, more particularly, to a lipstick case having a case holder with a non-circular profile on which a lid with a non-circular profile is easily covered.

A lipstick case based on the prior art generally includes a case holder, a sleeve installed in the case holder and used to hold a lipstick, and a lid covered on a top of the case holder. The sleeve has an upper segment protruding out of the top of the case holder and is provided with an actuator held inside. The lipstick can be extended from and retracted into the sleeve after the lid is removed and the case holder is turned relative to the sleeve. The lipstick retracted into the sleeve is further protected by the lid which has been covered on the case holder.

In general, the case holder is provided with one or a plurality of raised positioning portions formed on the top thereof and used to press against an inner wall of a bottom segment of the lid in order to position the lid which has been covered on the case holder of the lipstick case. However, the lid whose inner wall tightly resists the positioning portions of the case holder must be removed by one user who applies a larger force. On the other hand, the lid whose inner wall loosely resists the positioning portions of the case holder may be easily separated and dropped from the case holder.

Furthermore, it is inconvenient to adjust an angle of a lid with a non-circular profile, which needs to be positioned to and covered on a case holder of the lipstick case with a non-circular profile, and keep a specific side of the lid to align with a lateral wall of the case holder having a positioning part.

BRIEF SUMMARY OF THE INVENTION

Therefore, it is an objective of the present invention to overcome the aforementioned shortcoming and deficiency of the prior art by providing a lipstick case including a case holder and a lid, both of which have a non-circular profile, wherein the lid can be easily removed and truly integrated with the case holder.

To achieve this and other objectives, a lipstick case of the present invention includes a tubular case holder, a tubular lid, a first positioning member, and a second positioning member. The case holder includes an annular surrounding wall with non-circular cross sections and defining a chamber therein for receiving a lipstick. The case holder further includes an upper end face with a top opening in a top of the surrounding wall and in communication with the chamber. The lid is removably covered on the upper end face of the case holder and includes an annular sleeve wall with non-circular cross sections. The lid further includes a lower end face with a lower opening in a bottom of the sleeve wall. The first positioning member is mounted on the upper end face of the case holder and includes an annular body having non-circular cross sections and a plurality of corners. The first positioning member further includes a plurality of first lower magnets correspondingly installed in the corners of the first positioning member. Each of the plurality of first lower magnets has an upper end which is one of a north seeking pole and a south seeking pole. The second positioning member is engaged on the lower end face of the lid and includes an annular body having non-circular cross sections and a plurality of corners. The second positioning member further includes a plurality of first upper magnets correspondingly arranged in the corners of the second positioning member. Each of the plurality of first upper magnets has a lower end which is the other of the north seeking pole and the south seeking pole, so that the first and second positioning members attract to each other by the first upper magnets on the lower end face of the lid and the first lower magnets on the upper end face of the case holder, allowing the lower end face of the lid to be engaged with the upper end face of the case holder when the lid covers the case holder.

In a preferred form, the case holder has an annular top recess formed in the upper end face and around the top opening, and the first positioning member is engaged in the top recess of the case holder. The lid has an annular lower recess formed in the lower end face and around the lower opening, and the second positioning member is engaged in the lower recess of the lid.

In a preferred form, the first positioning member further includes a plurality of second lower magnets, with each of the second lower magnets installed between two adjacent first lower magnets. Each of the first lower magnets has a top magnetic pole contrary to that of each of the second lower magnets. The second positioning member further includes a plurality of second upper magnets, with each of the second upper magnets arranged between two adjacent first upper magnets. Each of the second upper magnets has a bottom magnetic pole contrary to that of each of the first upper magnets.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
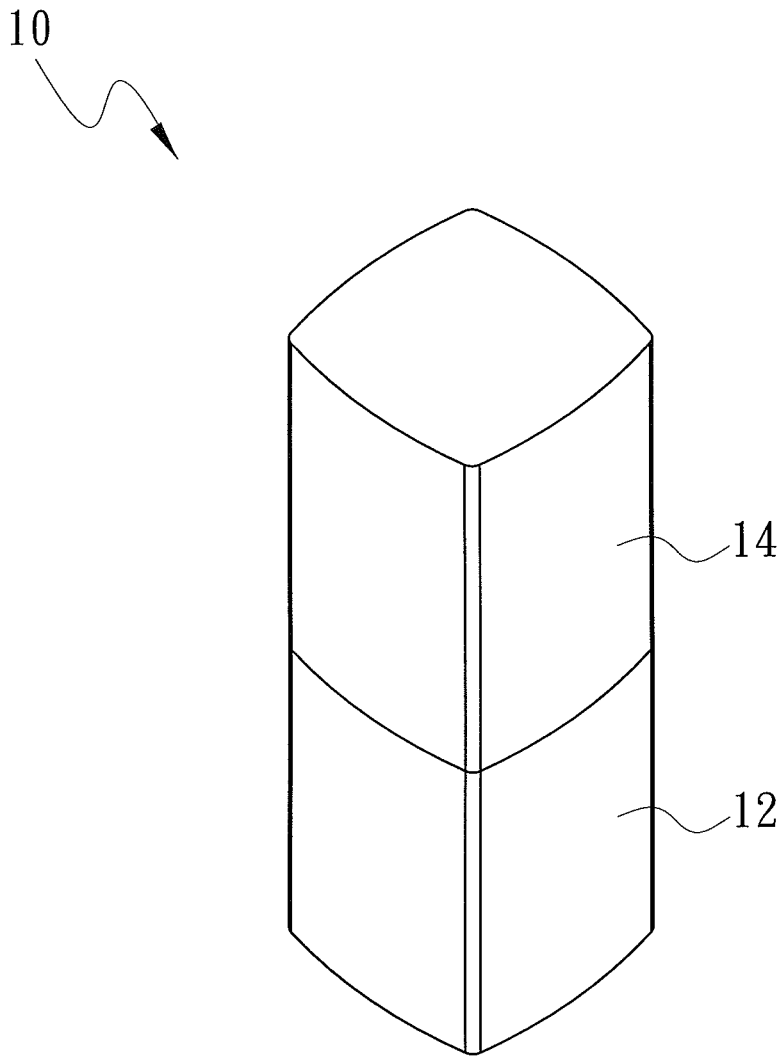
FIG. 1 is a perspective view of a lipstick case according to a first embodiment of the present invention.
Figure 2:
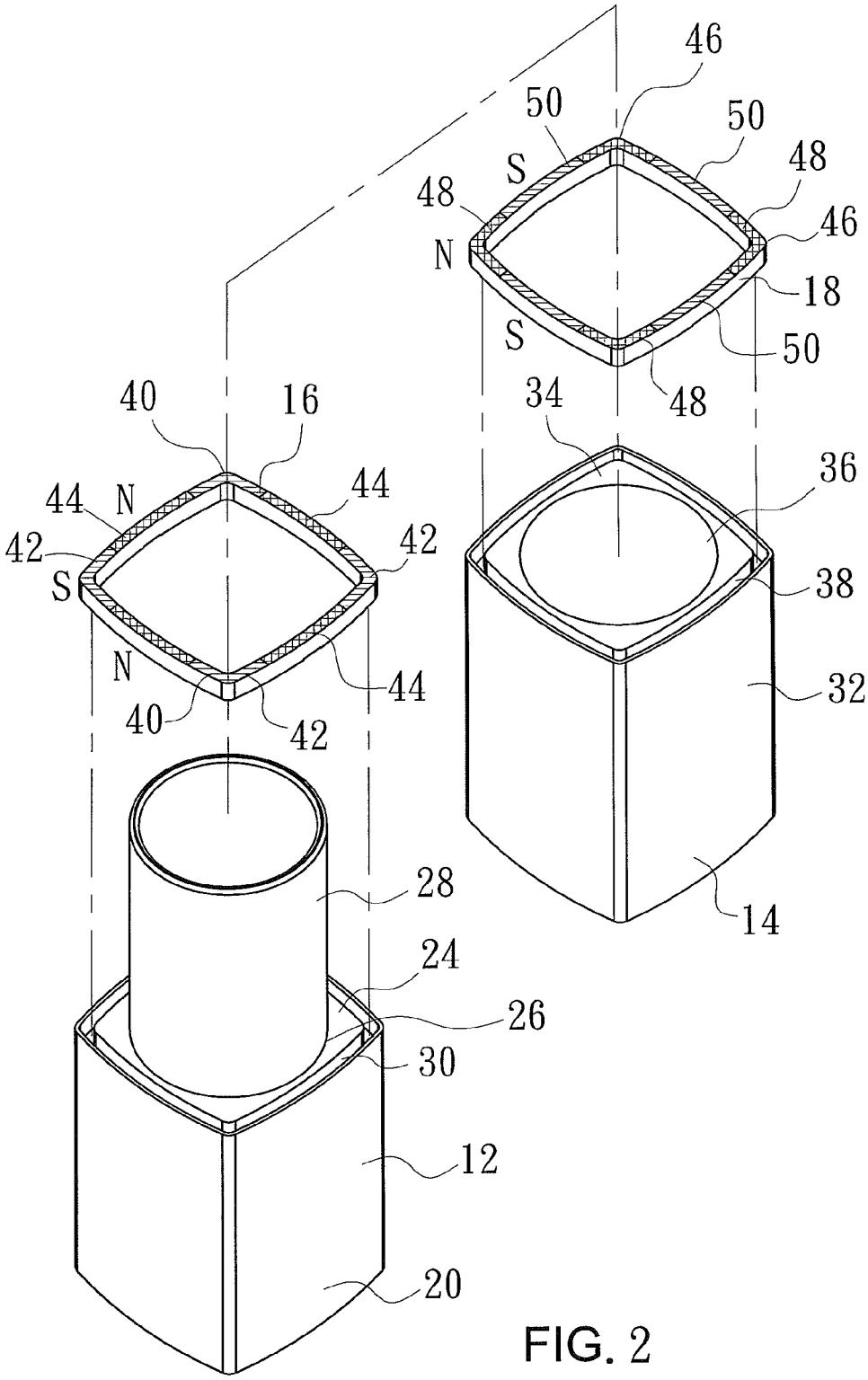
FIG. 2 is an exploded, perspective view of the lipstick case of FIG. 1.
Figure 3A:
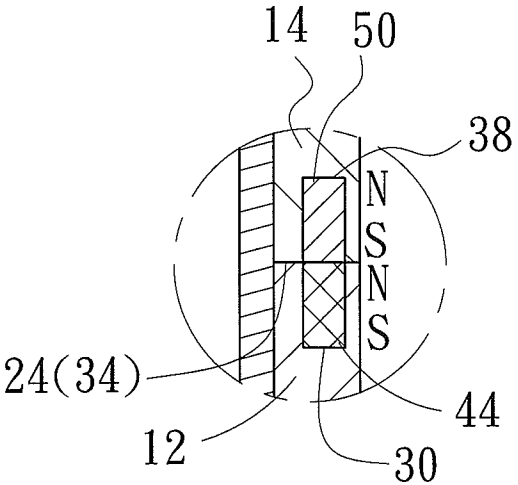
FIG. 3*a* is an enlarged view of a circled portion in FIG. 3.
Figure 3:
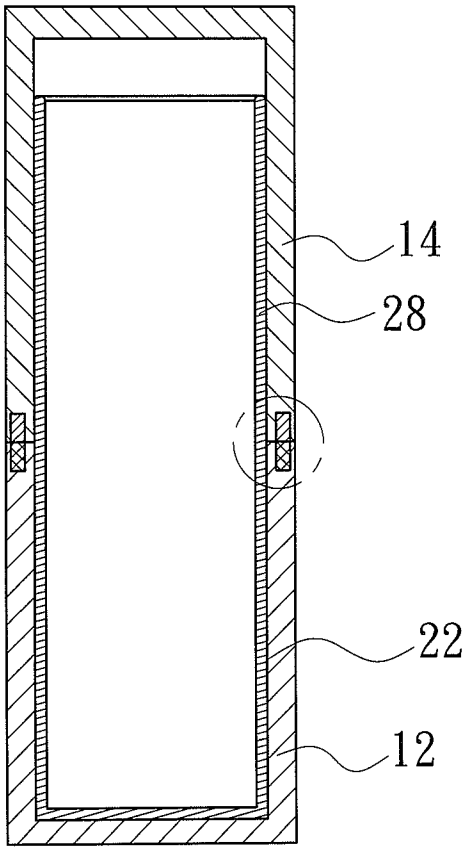
FIG. 3 is a schematic cross-sectional view of the lipstick case of FIG. 1.
Figure 4A:
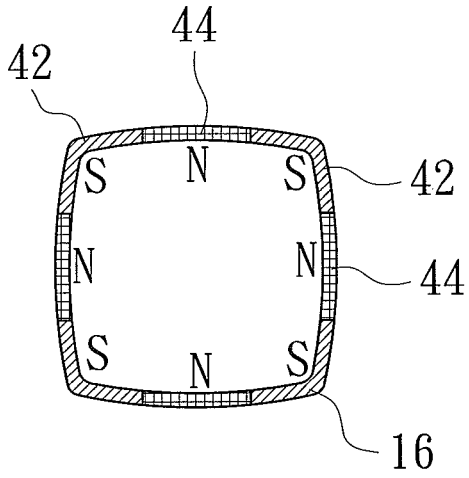
FIGS. 4*a* and 4*b* are schematic views illustrating first and second positioning members of the lipstick case of FIG. 2.
Figure 4B:
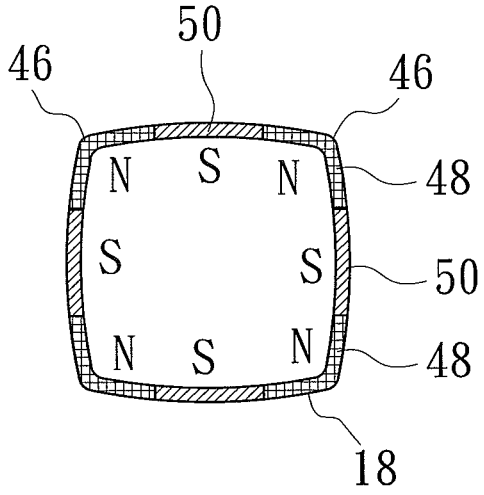

A lipstick case of an embodiment of the present invention is shown in FIGS. 1 through 5 of the drawings and generally designated 10. In the embodiment, the lipstick case 10 includes a tubular case holder 12, a tubular lid 14, a first positioning member 16, and a second positioning member 18.

The case holder 12 includes an annular surrounding wall 20 with non-circular cross sections perpendicular to an axial direction of the lipstick case 10. In the embodiment, the surrounding wall 20 has square-like cross sections and defines a chamber 22 therein for receiving a lipstick (not shown in the drawings). The case holder 12 further includes an upper end face 24 with a top opening 26 in a top of the surrounding wall 20 and in communication with the chamber 22. In the embodiment, the chamber 22 accommodates a sleeve 28 having an upper segment which protrudes out of the top opening 26. The sleeve 28 has an inner space in which the lipstick and an actuator (not shown) are held. The lipstick can be extended from or retracted into the sleeve 28 when the case holder 12 is turned relative to the sleeve 28. Further, the case holder 12 is designed to have an annular top recess 30 formed in the upper end face 24 and around the top opening 26.

The lid 14 includes an annular sleeve wall 32 with non-circular cross sections perpendicular to the axial direction of the lipstick case 10. In the embodiment, the sleeve wall 32 has square-like cross sections corresponding to the profile of the case holder 12 and has an outer diameter approximates to that of the surrounding wall 20 of the case holder 12. The lid 14 further includes a lower end face 34 with a lower opening 36 having an inner diameter slightly greater than the outer diameter of the sleeve 28, so that the lid 14 is removably mounted on the surrounding wall 20 of the case holder 12. The lower end face 34 of the lid 14 will contact the upper end face 24 of the case holder 12 when the lid 14 covers the case holder 12. Furthermore, the lid 14 is designed to have an annular lower recess 38 formed in the lower end face 34 and around the lower opening 36.

The first positioning member 16 is mounted on the upper end face 24 of the case holder 12. The first positioning member 16 is an annular body with non-circular cross sections and includes a plurality of corners 40. In the embodiment, the first positioning member 16 is embedded into the top recess 30 of the case holder 12 and includes four corners 40. The first positioning member 16 further includes a plurality of lower magnets. In the embodiment, the lower magnets include a plurality of first lower magnets 42 and a plurality of second lower magnets 44. Each of the first lower magnets 42 is correspondingly installed in one of the corners 40 of the first positioning member 16, and each of the second lower magnets 44 is installed between two adjacent first lower magnets 42 or centrally installed in one of sides of the first positioning member 16. In the embodiment, each of the first lower magnets 42 has a south seeking pole on its upper end, and each of the second lower magnets 44 has a north seeking pole on its upper end. That is, each of the first lower magnets 42 has a top magnetic pole (south seeking pole (S)) contrary to that (north seeking pole (N)) of each of the second lower magnets 44.

The second positioning member 18 is mounted on the lower end face 34 of the lid 14. The second positioning member 18 is an annular body with non-circular cross sections and includes a plurality of corners 46. In the embodiment, the second positioning member 18 is embedded into the lower recess 38 of the lid 14 and includes four corners 46. The second positioning member 18 further includes a plurality of upper magnets. In the embodiment, the upper magnets include a plurality of first upper magnets 48 and a plurality of second upper magnets 50. Each of the first upper magnets 48 is correspondingly arranged in one of the corners 46 of the second positioning member 18, and each of the second upper magnets 50 is arranged between two adjacent first upper magnets 48 or centrally installed in one of sides of the second positioning member 18. In the embodiment, each of the first upper magnets 48 has a north seeking pole on its lower end, and each of the second upper magnets 50 has a south seeking pole on its lower end. That is, each of the first upper magnets 48 has a bottom magnetic pole (north seeking pole (N)) contrary to that (south seeking pole (S)) of each of the second upper magnets 50.

Figure 5:
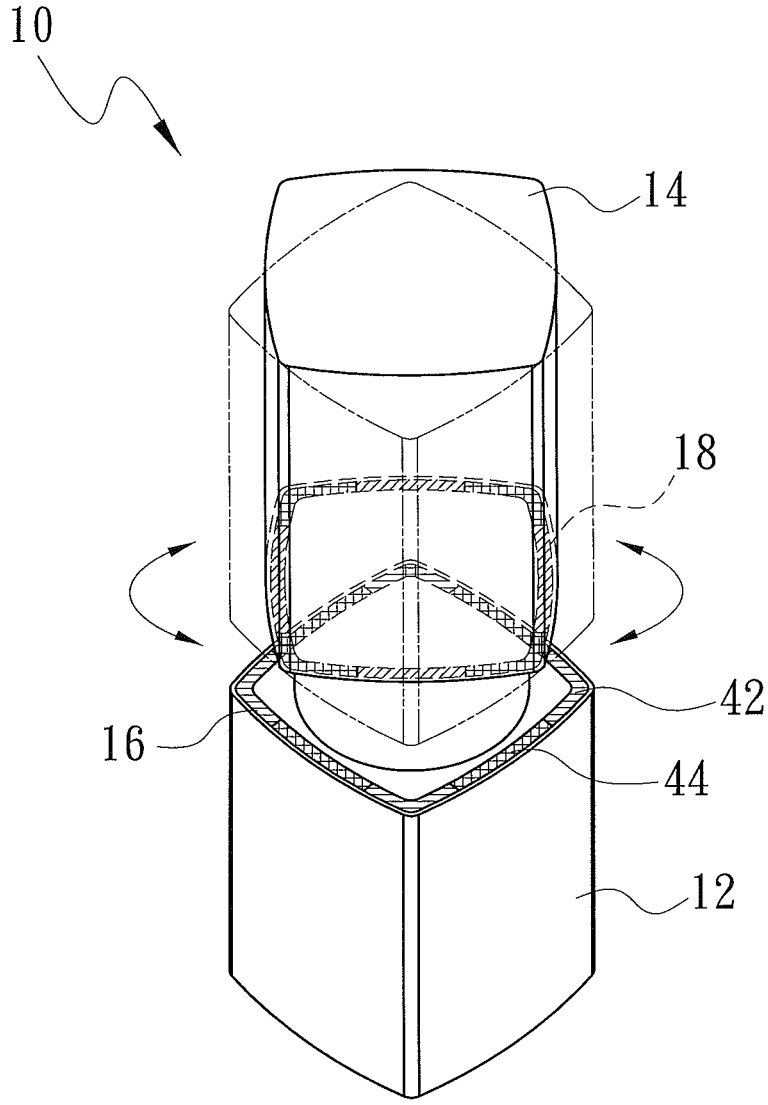
FIG. 5 is a schematic view illustrating a procedure to cover a lid of the lipstick case of FIG. 1.
Figure 6A:
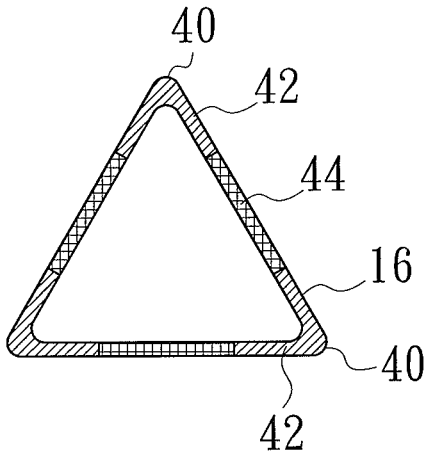
FIGS. 6*a* and 6*b* are schematic views similar to FIGS. 4*a* and 4*b*, illustrating first and second positioning members of a lipstick case according to a second embodiment of the present invention.
Figure 6B:
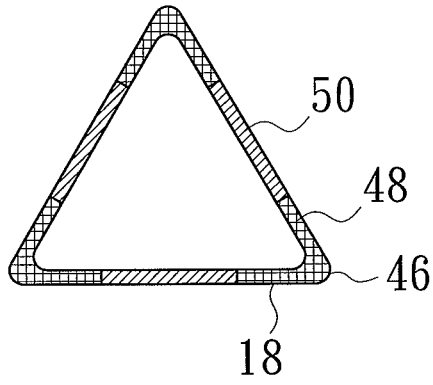
Figure 7A:
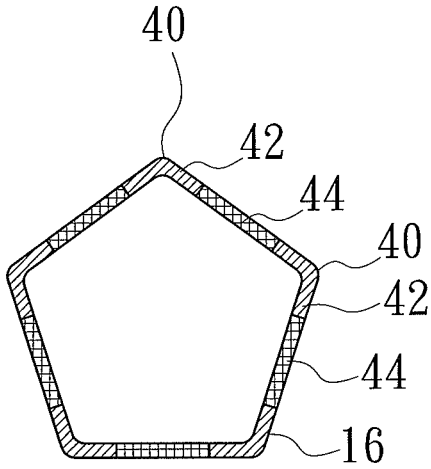
FIGS. 7*a* and 7*b* are schematic views similar to FIGS. 4*a* and 4*b*, illustrating first and second positioning members of a lipstick case according to a third embodiment of the present invention.
Figure 7B:
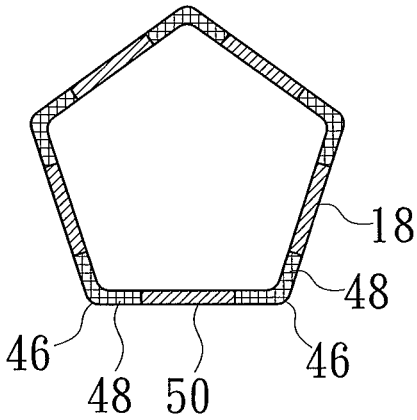
Figure 8A:
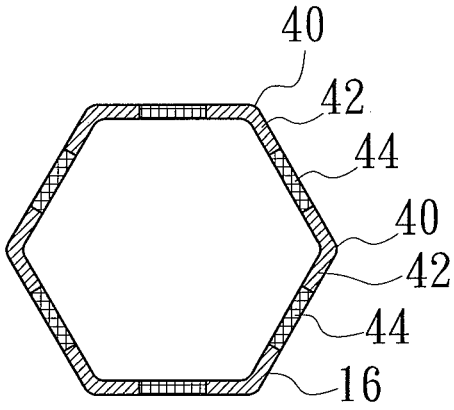
FIGS. 8*a* and 8*b* are schematic views similar to FIGS. 4*a* and 4*b*, illustrating first and second positioning members of a lipstick case according to a fourth embodiment of the present invention.
Figure 8B:
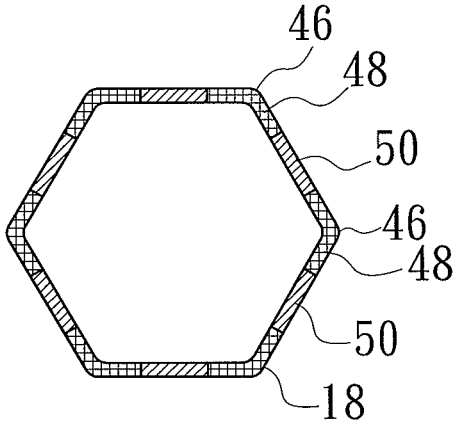
Figure 9A:
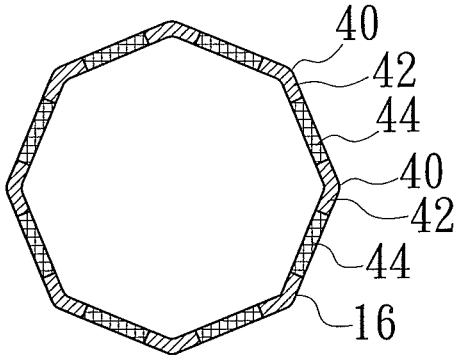
FIGS. 9*a* and 9*b* are schematic views similar to FIGS. 4*a* and 4*b*, illustrating first and second positioning members of a lipstick case according to a fifth embodiment of the present invention.
Figure 9B:
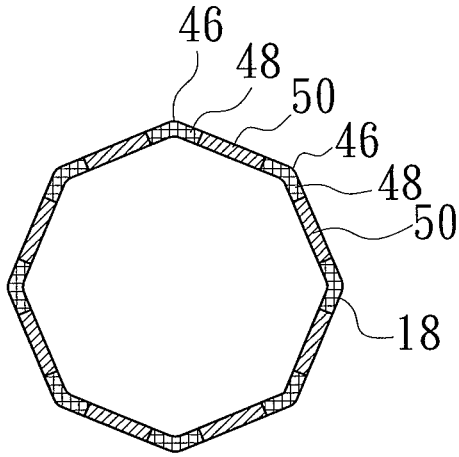

The lid 14 can be easily removed from the case holder 12 and truly coupled with the case holder 12 by one user, because the lipstick case 10 includes the lower magnets 42, 44 and the upper magnets 48, 50 with opposite magnetic poles which are installed in all corners of the upper end face 24 of the case holder 12 and all corners of the lower end face 34 of the lid 14, respectively. Specifically, the lid 14 covered on the case holder 12 can be positioned when polar attraction is developed between the upper magnets 48, 50 on the lower end face 34 of the lid 14 and the lower magnets 42, 44 on the upper end face 24 of the case holder 12. On the other hand, the lid 14 can be easily separated from the case holder 12 when a small force is applied on the lid 14 by one user. Furthermore, as shown in FIG. 5, depending on the principle of polar attraction or repulsion, the lid 14 approaching to the case holder 12 will automatically revolve and align with the case holder 12 due to same polarity at the bottom magnetic pole (north seeking pole (N)) of the first upper magnets 48 of the lid 14 and the top magnetic pole (north seeking pole (N)) of the second lower magnets 44 of the case holder 12 and same polarity at the bottom magnetic pole (south seeking pole (S)) of the second upper magnets 50 of the lid 14 and the top magnetic pole (south seeking pole (S)) of the first lower magnets 42 of the case holder 12, so that the lower magnets 42, 44 on the upper end face 24 of the case holder 12 attract the upper magnets 48, 50 on the lower end face 34 of the lid 14 for positioning purposes.

FIGS. 6 through 9 show alternative embodiments of the lipstick case 10 according to the present invention. FIGS. 6*a* and 6*b* illustrate the first and second positioning members 16 and 18 respectively have triangular cross sections. FIGS. 7*a* and 7*b* illustrate the first and second positioning members 16 and 18 respectively have pentagonal cross sections. FIGS. 8*a* and 8*b* illustrate the first and second positioning members 16 and 18 respectively have hexagonal cross sections. FIGS. 9*a* and 9*b* illustrate the first and second positioning members 16 and 18 respectively have octagonal cross sections. The first and second positioning members 16 and 18 with different non-circular profiles can be respectively integrated with the case holder 12 and the lid 14 having corresponding profiles.

It can be appreciated that the first and second positioning members 16 and 18 can individually join to the upper end face 24 of the case holder 12 and the lower end face 34 of the lid 14 by one-piece design, scarf, bolts, or other techniques.

The present invention improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

The invention claimed is:

1. A lipstick case comprising:

a tubular case holder including an annular surrounding wall with non-circular cross sections and defining a chamber therein for receiving a lipstick, with the case holder further including an upper end face with a top opening in a top of the surrounding wall and in communication with the chamber;

a tubular lid removably covered on the upper end face of the case holder and including an annular sleeve wall with non-circular cross sections, with the lid further including a lower end face with a lower opening in a bottom of the sleeve wall;

a first positioning member mounted on the upper end face of the case holder, with the first positioning member being an annular body having non-circular cross sections and a plurality of corners, with the first positioning member including a plurality of first lower magnets correspondingly installed in the corners of the first positioning member, with each of the plurality of first lower magnets having an upper end which is one of a north seeking pole and a south seeking pole; and a second positioning member mounted on the lower end face of the lid, with the second positioning member being an annular body having non-circular cross sections and a plurality of corners, with the second positioning member including a plurality of first upper magnets correspondingly arranged in the corners of the second positioning member, with each of the plurality of first upper magnets having a lower end which is another of the north seeking pole and the south seeking pole, with the lower end face of the lid capable of being engaged with the upper end face of case holder by the first upper and lower magnets.

2. The lipstick case as claimed in claim 1, with the case holder having an annular top recess formed in the upper end face and around the top opening, with the first positioning member engaged in the top recess of the case holder, with the lid having an annular lower recess formed in the lower end face and around the lower opening, with the second positioning member engaged in the lower recess of the lid.

3. The lipstick case as claimed in claim 2, with the first positioning member further including a plurality of second lower magnets, with each of the second lower magnets installed between two adjacent first lower magnets, with each of the first lower magnets having a top magnetic pole contrary to that of each of the second lower magnets, with the second positioning member further including a plurality of second upper magnets, with each of the second upper magnets arranged between two adjacent first upper magnets, with each of the first upper magnets having a bottom magnetic pole contrary to that of each of the second upper magnets.

4. The lipstick case as claimed in claim 1, with the first positioning member further including a plurality of second lower magnets, with each of the second lower magnets installed between two adjacent first lower magnets, with each of the first lower magnets having a top magnetic pole contrary to that of each of the second lower magnets, with the second positioning member further including a plurality of second upper magnets, with each of the second upper magnets arranged between two adjacent first upper magnets, with each of the first upper magnets having a bottom magnetic pole contrary to that of each of the second upper magnets.

* * * * *